US009293233B2

(12) United States Patent
Gazda et al.

(10) Patent No.: US 9,293,233 B2
(45) Date of Patent: Mar. 22, 2016

(54) COMPOSITE CABLE

(71) Applicant: TYCO ELECTRONICS CORPORATION, Berwyn, PA (US)

(72) Inventors: Jerzy Gazda, Enola, PA (US); Jessica Henderson Brown Hemond, Mifflintown, PA (US); Robert Daniel Hilty, Sunnyvale, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 13/764,310

(22) Filed: Feb. 11, 2013

(65) Prior Publication Data

US 2014/0224524 A1 Aug. 14, 2014

(51) Int. Cl.
*H01B 1/04* (2006.01)

(52) U.S. Cl.
CPC ..... *H01B 1/04* (2013.01)

(58) Field of Classification Search
CPC ..... H01B 1/04
See application file for complete search history.

(56) References Cited

U.S. PATENT DOCUMENTS

| | | | | |
|---|---|---|---|---|
| 3,396,054 | A | 8/1968 | Gremion | |
| 3,699,647 | A * | 10/1972 | Bidault et al. | 29/599 |
| 3,854,114 | A | 12/1974 | Kloth et al. | |
| 5,316,506 | A | 5/1994 | Ito | |
| 6,068,917 | A | 5/2000 | Tsuno et al. | |
| 6,828,501 | B2 * | 12/2004 | Eves | H01B 7/0266 174/109 |
| 7,345,242 | B2 | 3/2008 | Chen et al. | |
| 7,413,474 | B2 | 8/2008 | Liu et al. | |
| 7,422,789 | B2 | 9/2008 | Avakian et al. | |
| 7,491,883 | B2 | 2/2009 | Lee et al. | |
| 7,538,062 | B1 | 5/2009 | Dai et al. | |
| 7,578,909 | B2 | 8/2009 | Mano et al. | |
| 7,611,579 | B2 | 11/2009 | Lashmore et al. | |
| 7,651,766 | B2 | 1/2010 | Chen | |
| 7,750,240 | B2 | 7/2010 | Jiang et al. | |
| 7,968,072 | B2 | 6/2011 | Seal et al. | |
| 7,971,489 | B2 | 7/2011 | Pushparaj et al. | |
| 7,983,020 | B2 | 7/2011 | Min et al. | |
| 8,368,223 | B2 | 2/2013 | Standing | |
| 2001/0005647 | A1 | 6/2001 | Endo et al. | |
| 2002/0097966 | A1 | 7/2002 | Zelesnik | |
| 2004/0020681 | A1 | 2/2004 | Hjortstam et al. | |
| 2007/0151744 | A1 | 7/2007 | Chen et al. | |
| 2007/0202735 | A1 | 8/2007 | Hanks | |

(Continued)

FOREIGN PATENT DOCUMENTS

| | | |
|---|---|---|
| DE | 1471436 A1 | 3/1969 |
| DE | 4434217 A1 | 3/1996 |

(Continued)

OTHER PUBLICATIONS

Alvarenga, Jack et al., "High Conductivity Carbon Nanotube Wires from Radial Densification and Ionic Doping", Applied Physics Letters, vol. 97, 182106-1 to 182106-3 (published online Nov. 4, 2010).

*Primary Examiner* — William H Mayo, III
*Assistant Examiner* — Krystal Robinson

(57) ABSTRACT

A composite conductor is disclosed having an elongate support with an outer surface of a whisker-forming metallic, the conductor further having a carbon nanotube yarn intertwined with the elongate support. The yarn is infiltrated by self-assembled whiskers from the whisker forming metallic.

19 Claims, 2 Drawing Sheets

(56) References Cited

U.S. PATENT DOCUMENTS

| | | | | |
|---|---|---|---|---|
| 2007/0221887 | A1 | 9/2007 | Kodas et al. | |
| 2007/0284145 | A1* | 12/2007 | Scherer | 174/520 |
| 2007/0293086 | A1* | 12/2007 | Liu | H01B 11/1808 439/578 |
| 2008/0053952 | A1 | 3/2008 | Okada et al. | |
| 2009/0017361 | A1 | 1/2009 | Lim et al. | |
| 2009/0042455 | A1 | 2/2009 | Mann et al. | |
| 2009/0068241 | A1 | 3/2009 | Britz et al. | |
| 2009/0068884 | A1 | 3/2009 | Kim et al. | |
| 2009/0255706 | A1 | 10/2009 | Jiang et al. | |
| 2010/0000754 | A1* | 1/2010 | Mann et al. | 174/34 |
| 2010/0000770 | A1 | 1/2010 | Gupta et al. | |
| 2010/0052223 | A1 | 3/2010 | Kim et al. | |
| 2010/0122910 | A1 | 5/2010 | Chen | |
| 2010/0124622 | A1 | 5/2010 | Wang et al. | |
| 2010/0126631 | A1 | 5/2010 | Suh | |
| 2010/0144205 | A1 | 6/2010 | Searfass | |
| 2010/0226061 | A1 | 9/2010 | Sutton et al. | |
| 2010/0233472 | A1 | 9/2010 | Liu et al. | |
| 2010/0270513 | A1 | 10/2010 | Haylock et al. | |
| 2010/0272537 | A1 | 10/2010 | Haylock et al. | |
| 2011/0052478 | A1 | 3/2011 | Feng et al. | |
| 2011/0095237 | A1 | 4/2011 | Liu et al. | |
| 2011/0171364 | A1 | 7/2011 | Xing et al. | |
| 2011/0225820 | A1 | 9/2011 | Kondo et al. | |
| 2012/0107683 | A1 | 5/2012 | Kim et al. | |
| 2013/0025907 | A1 | 1/2013 | Zheng et al. | |
| 2013/0048337 | A1 | 2/2013 | Hemond et al. | |
| 2013/0126212 | A1 | 5/2013 | Martens et al. | |
| 2013/0217279 | A1 | 8/2013 | Hemond et al. | |

FOREIGN PATENT DOCUMENTS

| | | | |
|---|---|---|---|
| EP | 2151894 | A1 | 2/2010 |
| WO | WO-2006/039179 | A2 | 4/2006 |

* cited by examiner

COMPOSITE CABLE

FIELD

This application is directed to composite cables and more particularly to light weight composite cables formed with carbon nanotube components.

BACKGROUND

Carbon nanotubes (CNTs) were discovered in 1991 in the soot of a fullerene generator in which under certain reaction conditions, tube-like structures with a diameter of only several tens of nanometers, but with a length of several micrometers were present.

CNTs are part of the family of fullerenes and their walls consist, like those of fullerenes or like the planes of graphite, only of carbon, whereby the carbon atoms have a honeycomb-like structure with six corners. The diameter of the tubes is mostly in a range between 1 and 50 nm. Lengths of several millimeters for individual tubes and of up to 20 cm for tube bundles have been achieved.

Several outstanding properties of CNTs are, for example, their mechanical tensile strength and stiffness of about 40 GPa and 1 TPa, respectively (20 times and 5 times greater than that of steel). The current-carrying capacity and the thermal conductivity are also of interest. The current-carrying capacity of CNTs is approximately 1000 times greater than that of copper wires and the thermal conductivity at room temperature is about 6000 W/m*K, approximately twice that of diamond, the best naturally occurring thermal conductor.

Yarns built from CNTs are under development for use in electrical conductors to take advantage of the numerous desirable properties exhibited by CNTs. Twisted or braided yarns of CNT are being investigated to form larger diameter conductors to replace traditional copper wire, particularly in applications in which weight reduction is important, such as in spacecraft and aircraft applications.

Among the challenges associated with the use of CNT yarns as electrical conductors is the occurrence of splitting or unfolding of those yarns when cut or trimmed. Such fraying can result in difficulty inserting the conductor into terminals. In addition, high impurity or residual catalyst content in the CNT yarns that are currently commercially available can result in non-uniform mechanical and electrical performance. That in turn can result in discontinuities or circuitous travel along the electrical path of the yarn. Those contaminants also make the conductor susceptible to environmental effects, such as corrosion and thermal degradation.

These and other drawbacks are found in the use of CNTs as electrical conductors.

SUMMARY

Exemplary embodiments are directed to a CNT composite conductor that can exhibit improved conductivity, uniform mechanical and electrical performance, ease of solderability, and is resistant to unfolding or un-braiding of the structure when field trimmed.

According to an exemplary embodiment of the invention, a composite conductor is disclosed. The composite conductor includes an elongate support having an outer surface comprising a whisker forming metallic layer and a carbon nanotube yarn intertwined with the elongate support. The yarn is infiltrated by self-assembled whiskers from the whisker forming metallic.

In one embodiment, the composite conductor is an elongate metallic support that forms a conductor core in which the whisker-forming metallic is a whisker forming metallic coating overlying the core. The whisker forming metallic material is typically selected from the group consisting of tin, indium, gallium, and combinations of these materials.

In yet another embodiment, a terminated connector includes a carbon nanotube yarn and a conductive terminal, the terminal comprising a whisker-forming metallic coating secured to the conductor. The conductor is infiltrated by a plurality of self-assembled whiskers extending from the terminal.

An advantage of certain exemplary embodiments is that a lightweight composite conductor is provided that exhibits improved conductivity and more uniform mechanical and electrical performance.

Another advantage of certain exemplary embodiments is that a lightweight composite conductor is provided that can more easily be terminated and improve ease of solderability, in addition to resistance to unfolding or un-braiding when cut and stripped to length.

Another advantage of certain exemplary embodiments of the invention is that a support is present in the composite conductor that can aid to resist crushing of the CNT fibers when the conductor is terminated.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Figure 1A:
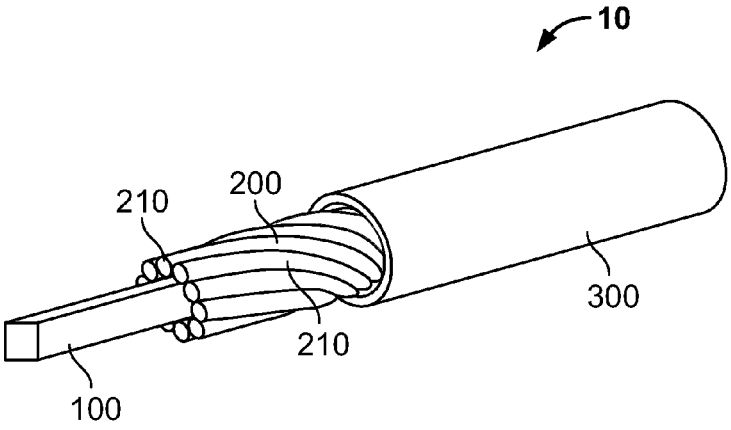
FIG. 1*a* illustrates a perspective view of a composite conductor in accordance with an exemplary embodiment.
Figure 1B:
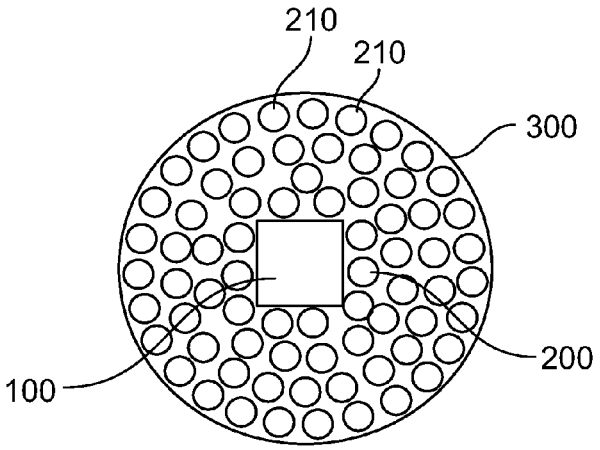
FIG. 1*b* illustrates an end, cross-sectional view of the composite conductor of FIG. 1*a*.

Turning to FIGS. 1*a* and 1*b*, a composite cable 10 is illustrated. The cable 10 is a cable that includes a support 100 and a plurality of CNT threads 210 that form a yarn 200 intertwined with the support 100.

The support 100 may be provided as a central core as illustrated in FIGS. 1*a* and 1*b* about which the CNT yarn 200 is wrapped to intertwine the two components. Alternatively, or in combination depending upon the total number of supports to be included, the support 100 may be eccentric, either in a generally fixed location that extends the length of the cable 10 or in which the support 100 wraps helically with the yarn 200 about a central axis. Although one support is illustrated in FIGS. 1*a* and 1*b*, it will be appreciated that certain embodiments may employ up to three, up to five, or even more supports 100 intertwined with the CNT yarn.

The support 100 is any suitable elongate support structure incorporated into the cable 10 and typically the support itself is a conductor, such as a solid (i.e. single-stranded) or multi-stranded metallic wire. The use of a conductive support 100 provides a continuous length of a conductive pathway through the cable 10.

The yarn 200 comprises a plurality of macroscopic CNT threads 210, which may themselves be a yarn of still thinner macroscopic or microscopic strands of CNT fibers and/or CNT staples. It will be appreciated that individual CNTs within the threads 210 that make up a CNT yarn 200 are of a determinate length. As a result, mechanical breaks may occasionally occur in the macrostructure of the CNT yarns 200. This causes an increased resistance in the yarn 200 that can result in non-uniform mechanical and electrical performance of the yarn 200 as a conductor. The additional conductive path provided by the use of a conductive support 100 can overcome that concern by bridging any mechanical breaks that may occur in the CNT macro-structure. This in turn can provide a cable 10 that is more uniform in mechanical and electrical performance.

In some embodiments, the cable 10 may also include an outer jacket 300 containing one or more layers of an insulating material that is typically wrapped or extruded over the formed support/yarn structure. The outer jacket 300 can be any suitable insulating material used in conjunction with electrical conductors, although rugged, lightweight materials such as polyetheretherketone (PEEK) may be preferred for spacecraft and aircraft applications.

In embodiments in which the support 100 is conductive, a preferred material of construction is copper and alloys thereof. However, any other conductive metal may also be employed for the support 100 and includes tin, aluminum, silver, gold, nickel, palladium, iron, their respective alloys, and combinations thereof.

Figure 2A:
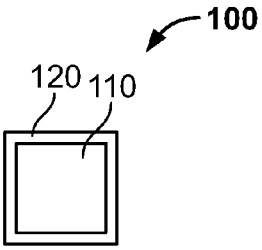
FIGS. 2*a* through 2*c* depict end views that illustrate various cross-sectional shapes of supports used with composite conductors in accordance with exemplary embodiments.
Figure 2B:
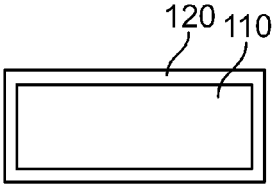
Figure 2C:
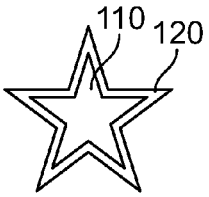

The support 100 may be of any cross-section, although it may advantageously be shaped with a non-circular cross-section to enhance whisker formation as described subsequently in more detail. Referring to FIGS. 2*a* through 2*c*, any suitable cross-sectional shape may be employed, including square, rectangular and star shapes.

The support 100 may be of any size, which may depend on a variety of factors, including the overall diameter of the cable 10 and the number of supports 100 to be incorporated, for example. It will be appreciated however, that the support 100 generally has a cross section in which the longest dimension is less than about 100 microns. Cross-sections in which the longest dimension is in the range about 10 microns to about 100 microns are typical, although a wider range, such as between 1 micron up to 1 millimeter, may be employed. For simple cross-sectional shapes using ductile supports 100, a wire of copper or other metal can be drawn to the desired shape. More complex cross-sectional shapes, such as the star shown in FIG. 2*c*, may be extruded directly to the desired effective diameter.

The support 100 is plated with, or optionally constructed from, a self-assembling metallic material. Such materials are known in the art and include tin, gallium, indium and certain alloys thereof, by way of example, that form self-assembling micro or nano-size features that grow from the surface on which the metallic material is present. These features look like, and are commonly referred to in the art as, whiskers. Whisker growth is a known, spontaneously induced characteristic of tin and other materials that exhibit this effect under certain aging conditions. However, the presence of whiskers has consistently been the source of efforts to eliminate them in conventional conductors because of their deleterious effects in those constructions, including the potential to cause short circuits.

Conversely, exemplary embodiments seek to promote whisker growth, using a support that includes whisker forming materials in combination with the CNT yarns 200 such that the whiskers extend from the support 100 to infiltrate the fibers of the yarn 200 that is intertwined therewith.

Figure 3:
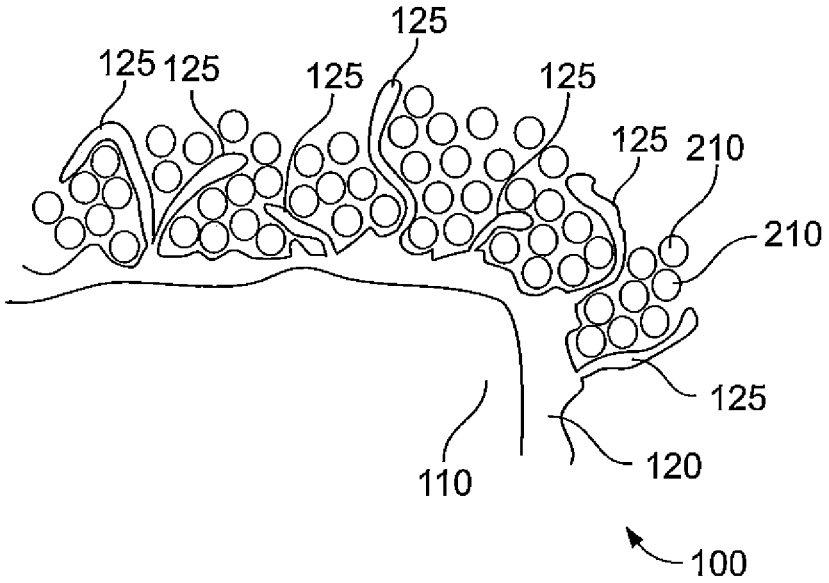
FIG. 3 schematically depicts an enlarged portion of a composite conductor cross-section that illustrates infiltration of self-assembled whisker growth.

Turning to FIG. 3, an enlarged view of an exterior portion of a support 100 of a support core 110 plated with a whisker forming layer 120 (which may advantageously be a tin-plated copper wire), in which the support 100 has been intertwined with the CNT yarn 200 as shown, for example, in FIGS. 1*a* and 1*b*. Self assembled whiskers 125 extend away from the surface of the support 100. The whiskers 125 extend into and between the individual CNT fibers 210 of the yarn 200 intertwined with the support 100. The whisker growth extends from the surface of the support 100 in random directions. The thickness of the whisker forming layer 120 can be of any suitable thickness to result in whisker growth, although a thickness of about 1 micron is ordinarily sufficient and lesser thicknesses may also still provide adequate results.

Whisker growth may be induced and controlled by a variety of factors, including time, temperature and humidity. Exemplary conditions suitable for the growth of tin whiskers include temperatures around 60° C. in combination with high humidity levels, i.e. relative humidity of about 85%. It will be appreciated, however, that other temperature and humidity levels can also result in whisker growth and the conditions under which that growth occurs is within the understanding of those of ordinary skill in the art. Furthermore, while a variety of conditions can cause whisker growth, the rate and incidence of whisker growth is also related to the shape of the structure from which the whiskers propagate, with whiskers most likely to be induced at stress points in the whisker forming coating.

Accordingly, supports 100 having a cross-sectional shape with multiple corners, such as those shown in FIGS. 2*a* through 2*c*, are preferred, thereby increasing the number of stress points from which whisker growth is likely to propagate. While rounded edges or even circular cross-sections are not precluded, the sharper the angle of edges and the greater the number of stress points, the greater the instance of whisker growth away from the support into the macro-structure of the yarn 200.

Whisker growth can also be induced by introduction of intentional stress points at the interface of the support core 110 and the whisker forming layer 120. One such mechanism is the formation of intermetallic alloys (phases) by processing at elevated or aging temperatures.

Whisker growth is typically initiated after intertwining the yarn 200 with the support 100, although it will be appreciated that some or even extensive whisker growth can occur prior to intertwining the yarn 200 and the support 100.

The infiltration of the whiskers 125 into the CNT yarn 200 provides mechanical reinforcement. The whiskers 125 further increase the number of available conductive paths within the cable 10, meaning that even in the event of a mechanical break of one or more CNT strands 210, the whiskers 125 can provide alternate conductive paths for enhanced electrical reliability. The existence of whiskers also promotes solderability of the composite wire and/or the ability to use conductive adhesives by generating a larger surface area for contact with solder/adhesive that also infiltrates the yarn 200.

The use of a support 100 in combination with CNT yarns 200 to form composite cables 10 in accordance with exemplary embodiments (with or without whisker growth) provides a variety of advantages in forming a CNT-based conductor. Among the improvements achieved is easier formation of the composite cable 10 during twisting/braiding operations by providing a continuous reinforcement backbone for the yarn 200. Other advantages include a volume increase and bundling capability, as well as providing anchor points for secondary reinforcement in the composite structure. It will further be appreciated that a conductive support 100 can act as an anodic protection plate when exposed to a corrosive environment (such as may be experienced as a result of fugitive catalyst content in the CNT yarn 200), as well as providing an anchor point for adhesion of solder for terminating the cable 10. The support 100 also provides a mechanical back-bone that can prevent crushing the yarn in crimped terminals.

The use of supports 100 coated or constructed of a whisker forming material resulting in self-assembled whiskers 125 can provide even more performance improvements as the whiskers propagate from the surface of the support 100 to infiltrate the CNT yarn 200 in accordance with exemplary embodiments. The additional improvements that can be achieved include easier forming of conductive yarns from composite materials during twisting or braiding operations with the whiskers acting as secondary reinforcement structures for individual conductive fibers in the twine or braided wires. The whiskers 125 also enhance the ability of the support 100 to provide multiple additional conductive paths that allow bridging of mechanical breaks that may occur in the yarn macro-structure, yielding multiple connection points between the bulk of the CNT yarn 200 and a continuous conductive support. The whiskers also expand the usefulness of the support 100 to act as the anodic protection plate in corrosive environments, provide an additional surface area for adhesion of solder used in terminal connections, and in providing the mechanical back-bone to prevent crushing in crimped terminals.

Figure 4:
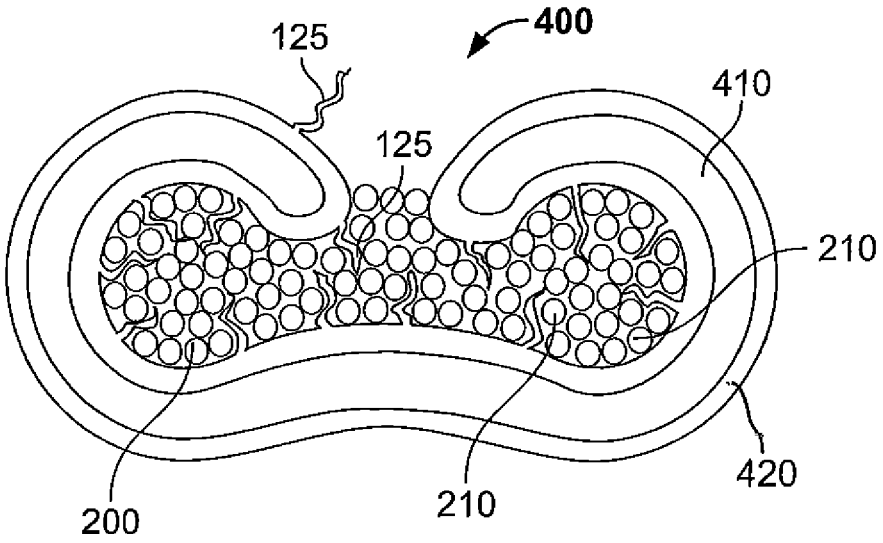
FIG. 4 schematically depicts an end-view of a crimped composite conductor in accordance with exemplary embodiments.

The advantages achieved by whisker growth infiltration into CNT yarn 200 may also advantageously be employed in conjunction with CNT based conductors regardless of whether a support 100 is intertwined therewith. Turning to FIG. 4, whisker growth can also be used with a terminal 400 that is crimped or otherwise used to terminate a conductor comprising a CNT yarn 200. In a manner analogous to the support 100 described above, the terminal 400 includes a coating 420 of a whisker forming material plated over a terminal core 410. Whiskers 125 propagate from the surface of the terminal 400 to infiltrate the yarn 200.

As previously described with respect to the support 100, whisker infiltration from the terminal 400 likewise increases mechanical coupling of the CNT fibers 210 of the yarn 200 with the terminal 400, as well as increasing the number of electrical paths between the cable 10 and the terminal 400 in the event of mechanical breaks in the yarn macrostructure. The infiltration of whiskers from the terminal 400 also provides an anchor point for adhesion of solder used in making the terminal connections.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A composite conductor comprising:

an elongate support having (i) an outer surface comprising a whisker forming metallic layer, and (ii) a non-circular cross-section; and a carbon nanotube yarn intertwined with the elongate support, wherein the yarn is infiltrated by self-assembled whiskers from the whisker forming metallic layer.

2. The composite conductor of claim 1, wherein the elongate support is selected from the group consisting of copper, tin, aluminum, silver, gold, nickel, palladium, iron, their respective alloys, and combinations thereof.

3. The composite conductor of claim 1, wherein the whisker forming metallic is an outer coating of the elongate support.

4. The composite conductor of claim 1, wherein the whisker forming metallic is selected from the group consisting of tin, indium, gallium, and combinations thereof.

5. The composite conductor of claim 1, wherein the elongate support is a central core about which the carbon nanotube yarn is wrapped.

6. The composite conductor of claim 1, wherein the elongate support is eccentric with respect to an axis of the composite conductor.

7. The composite conductor of claim 1, further comprising a first end terminated in a terminal, the terminal comprising an outer layer of a whisker forming metallic.

8. The composite conductor of claim 1 wherein the elongate support having an outer surface comprising a whisker forming metallic comprises a tin-coated copper wire, the wire having a non-circular cross-section.

9. The composite conductor of claim 1, wherein the elongate conductor has a cross-section in which a longest dimension is in the range of 1 micron to 1 millimeter.

10. The composite conductor of claim 1 further comprising an outer jacket overlying the intertwined elongate support and carbon nanotube yarn.

11. The composite conductor of claim 10, wherein the outer jacket comprises an insulating polymeric material.

12. A composite conductor comprising:

an elongate metallic support forming a conductor core and having (i) an outer surface comprising a whisker-forming metallic coating, and (ii) a non-circular cross-section; and a carbon nanotube yarn intertwined with the elongate support, wherein the yarn is infiltrated by self-assembled whiskers from the whisker-forming metallic coating.

13. The composite conductor of claim 12, wherein the whisker-forming metallic coating is selected from the group consisting of tin, indium, gallium, combinations thereof and whisker-forming alloys thereof.

14. The composite conductor of claim 13, wherein the elongate support is a wire selected from the group consisting of copper, tin, aluminum, silver, gold, nickel, palladium, iron, their respective alloys, and combinations thereof.

15. The composite conductor of claim 14, wherein the elongate support is a solid conductor.

16. The composite conductor of claim 12, wherein the non-circular cross-section has a longest dimension in the range of 1 micron to about 1 millimeter.

17. A terminated connection comprising a conductor comprising an elongate support (i) having a non-circular cross-section, and (ii) comprising a carbon nanotube yarn; and a conductive terminal comprising a whisker-forming metallic coating secured to the conductor, wherein the conductor is infiltrated by a plurality of self-assembled whiskers extending from the terminal.

18. The terminated connection of claim 17, wherein the elongate support comprises a whisker forming metallic intertwined with the carbon nanotube yarn.

19. The terminated connection of claim 17, wherein the whisker-forming metallic coating comprises tin, indium, gallium, or whisker-forming alloys thereof.

* * * * *